US005398704A

United States Patent [19]

Dombeck

[11] Patent Number: 5,398,704

[45] Date of Patent: Mar. 21, 1995

[54] FRENCH MANICURE TEMPLATES

[76] Inventor: Danice J. Dombeck, N2167 Rausch Rd., Lodi, Wis. 53555

[21] Appl. No.: 186,315

[22] Filed: Jan. 25, 1994

[51] Int. Cl.[6] ..... A45D 29/00

[52] U.S. Cl. ..... 132/285; 434/100

[58] Field of Search ..... 132/73.5, 75.3, 76.4, 132/285; 434/99, 100, 104

[56] References Cited

U.S. PATENT DOCUMENTS

| | | | |
|---|---|---|---|
| 2,020,100 | 11/1935 | Boyd | 434/100 |
| 2,393,371 | 1/1946 | Harris | 434/100 |
| 2,417,677 | 3/1947 | Cohan | 434/100 |
| 2,807,270 | 9/1957 | Patterson | 132/285 |
| 2,840,088 | 6/1958 | Kushner | 132/285 |

*Primary Examiner*—John G. Weiss

[57] ABSTRACT

French manicure templates comprising a lower template positionable in a horizontal plane wherein a representation of a human hand and aligning notches are printed thereon, and a wedge shaped upper template, positionable in overlapping relationship with the lower template such that a person's hand may be interposed therebetween; the upper template is provided with corresponding aligning notches and a plurality of variable size nail masks about the peripheral edge thereof.

4 Claims, 4 Drawing Sheets

FIG 1
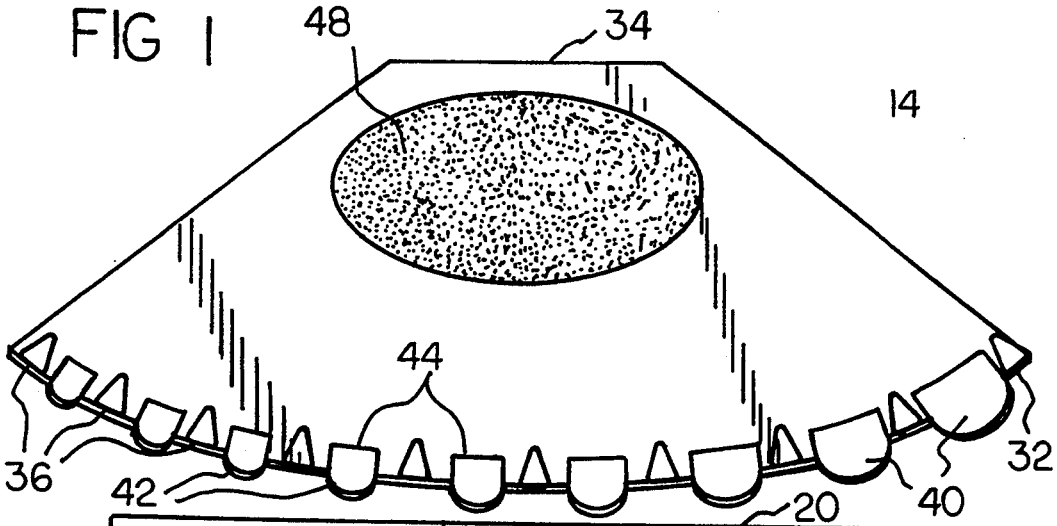
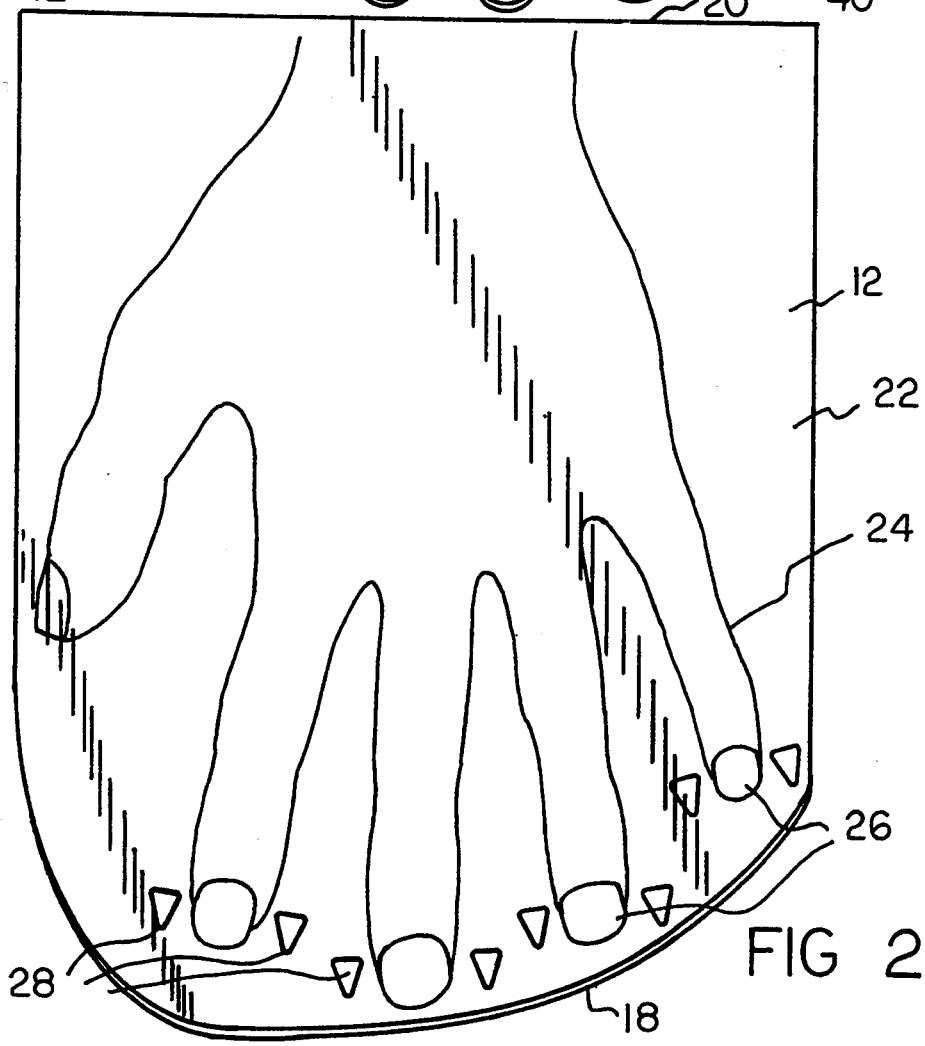
FIG 2

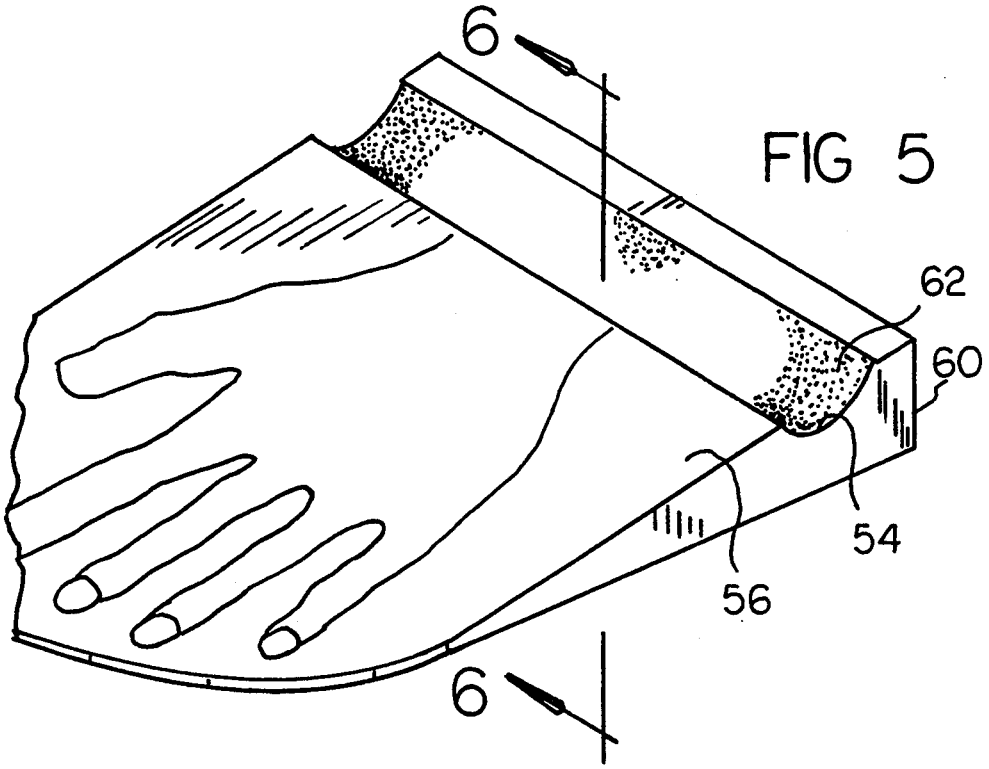
FIG 5
FIG 6
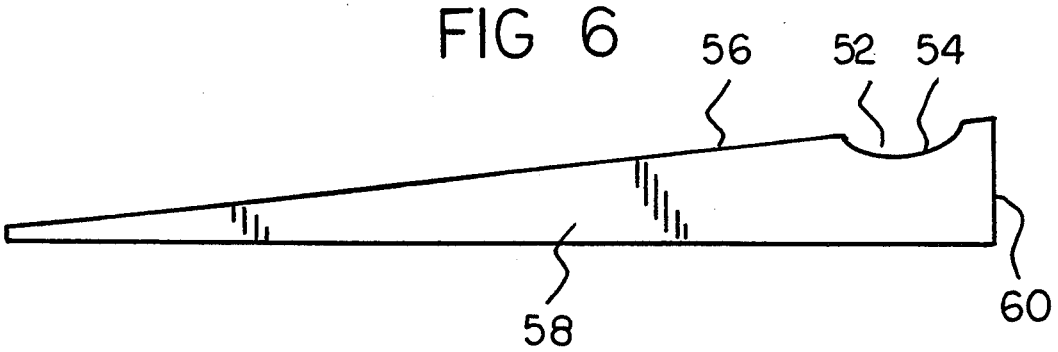

FRENCH MANICURE TEMPLATES

BACKGROUND OF THE INVENTION

1. Field of the Invention

The present invention relates to French manicure templates and more particularly pertains to templates for painting curved lines on the tips of fingernails.

2. Description of the Prior Art

The use of nail templates is known in the prior art. More specifically, nail templates heretofore devised and utilized for the purpose of keeping nail polish from adhering to the skin adjacent the fingernail area are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. Nos. 3,461,885 to Coveney and 5,150,726 to Rucker masks for placement around nails to prevent nail polish from inadvertent deposition on cuticle and skin tissue.

U.S. Pat. Nos. 4,984,592 to Hellein and 5,085,234 to Silverman disclose shields for placement around fingernails to protect drying polish thereon.

U.S. Pat. No. 4,767,648 to Hokama teaches a method for applying crescent shaped tabs to the forward tips of human fingernails.

In this respect, the French manicure templates according to the present invention substantially depart from the conventional concepts and designs of the prior art, and in doing so provide an apparatus primarily developed for the purpose of painting curved lines on the tips of fingernails.

Therefore, it can be appreciated that there exists a continuing need for new and improved French manicure templates which can be used for painting curved lines on the tips of fingernails. In this regard, the present invention substantially fulfills this need.

SUMMARY OF THE INVENTION

In view of the foregoing disadvantages inherent in the known types of nail templates now present in the prior art, the present invention provides improved French manicure templates. As such, the general purpose of the present invention, which will be described subsequently in greater detail, is to provide new and improved French manicure templates and method which have all the advantages of the prior art and none of the disadvantages.

To attain this, the present invention essentially comprises a lower template to accept placement of a person's entire hand, and an upper template positionable in overlapping relationship with the lower template. The lower template is provided with a graphic representation of a human hand printed thereon and further contains a series of alignment notches printed about the outer edge of the template. The upper template is wedge-shaped and further contains corresponding alignment notches printed on the outer peripheral edge thereof. The upper template additionally contains a series of nail masks of varying size attached to the template between the alignment notches. In use, a person may place his/her hand on the lower template such that the hand is superimposed above the graphic hand representation. The user then selects the appropriate nail mask size from the upper template, and using the alignment notches, positions the appropriate masks above the nail to be painted.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved French manicure templates which have all the advantages of the prior art nail templates and none of the disadvantages.

It is another object of the present invention to provide new and improved French nail templates which may be easily and efficiently manufactured and marketed.

It is a further object of the present invention to provide new and improved French manicure templates which are of durable and reliable constructions.

An even further object of the present invention is to provide new and improved French manicure templates which are susceptible of a low cost of manufacture with regard to both materials and labor, and which accordingly are then susceptible of low prices of sale to the consuming public, thereby making such French manicure templates economically available to the buying public.

Still yet another object of the present invention is to provide new and improved French manicure templates which provide in the apparatuses and methods of the prior art some of the advantages thereof, while simultaneously overcoming some of the disadvantages normally associated therewith.

Even still another object of the present invention is to provide templates to enable the painting of curved lines on the tips of fingernails.

Lastly, it is an object of the present invention to provide new and improved French manicure templates comprising a lower template positionable in a horizontal plane wherein a representation of a human hand and aligning notches are printed thereon, and a wedge shaped upper template, positionable in overlapping relationship with the lower template such that a person's hand may be interposed therebetween; the upper template is provided with corresponding aligning notches and a plurality of variable size nail masks about the peripheral edge thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the French manicure templates constructed in accordance with the principles of the present invention.

FIG. 2 is a top view of the lower template of the present invention.

FIG. 5 is a perspective view of an alternate embodiment of the present invention.

FIG. 6 is a cross-sectional view taken along line 6—6 of FIG. 5.

The same reference numerals refer to the same parts throughout the various Figures.

DESCRIPTION OF THE PREFERRED EMBODIMENT

Figure 3:
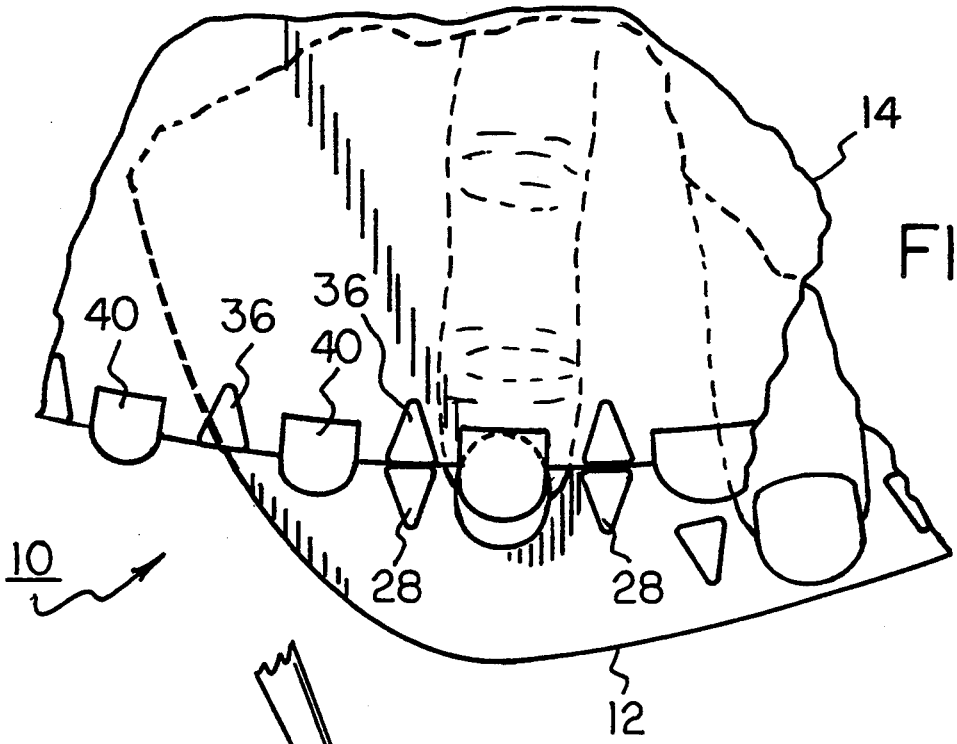
FIG. 3 is a top view showing the preferred embodiment in use.

With reference now to the drawings, and in particular to FIG. 1 thereof, the preferred embodiment of the new and improved French manicure templates embodying the principles and concepts of the present invention and generally designated by the reference numeral 10 will be described.

Specifically, it will be noted in the various Figures that there are provided French manicure templates 10. In their broadest of terms, the templates include a lower template 12 and an upper template 14.

In the preferred embodiment of FIGS. 1 through 4, the lower template 12 comprises a generally parabolic shaped lower template 12 having a rounded forward edge 18 and a square rearward edge 20. The lower template 12 is configured to accept placement of a person's entire hand. The lower template 12 is positionable in a horizontal plane. It is preferably fabricated of solid construction. The template tapers from a larger thickness at the square rearward edge to a smaller thickness at the rounded forward edge. Note FIGS. 5 through 8. The lower template 12 further contains a sloped upper surface 22 wherein a representation 24 of a human hand, preferably formed thereon as by printing, includes five fingernail defining areas 26 formed thereon. The sloped upper surface further contains a plurality of outwardly pointed triangular notches 28 formed about the rounded forward edge thereof in fixed spaced relationship. Each fingernail defining area 26 is interposed in linear relationship between two triangular notches 28.

An upper template 14 is also provided. Such upper template 14 is positionable in a horizontal plane and in overlapping relationship with the lower template 12 such that a person's hand may be interposed therebetween. The upper template 14 is wedge-shaped and has a curved peripheral edge 32 and a square rearward edge 34. The upper template is further provided with a plurality of inwardly pointed triangular notches 36 being disposed in fixed spaced-apart relationship about the curved peripheral edge 32 of the upper template.

The curved peripheral edge 32 of the template is further provided with a plurality of semi-circular flexible nail masks 40 of varying size. The nail masks contain a rounded edge 42 and a square edge 44. The square edge is fixedly attached to the template and the rounded edge extending beyond the curved peripheral edge of the template. The nail masks 40 are arranged on the template in order of progressively increasing size and in alternating spaced relationship with the inwardly pointed triangular notches 36.

The upper template further contains on its opposite side an elliptical grip 48 of sponge-like fabrication. The grip may be formed of polystyrene, polyurethane foam, silicone rubber, apoxide resin, or any of the known resins or composites of the art. The grip allows for ease in handling and placement of the upper template in superimposed relationship with the lower template.

Figure 4:
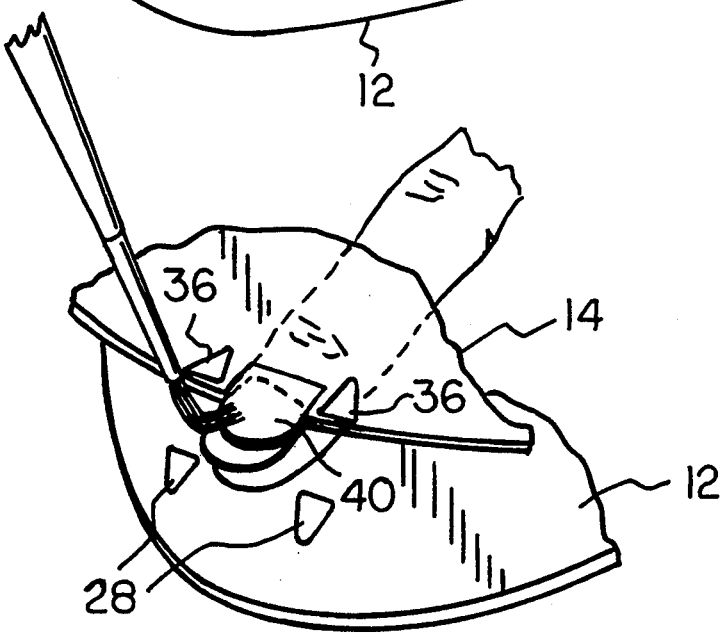
FIG. 4 is a partial perspective view showing nail polish being applied in accordance with the present invention.

In use, as best shown in FIGS. 3–4, the user places his/her hand on the lower template 12. The correct nail size is then selected from the nail masks 44 on the upper template. The masks 44 are secured to the upper template 14 by glue, an adhesive tape or other appropriate means. The user then places the upper template 14 and chosen mask 40 above the fingernail to be painted. To achieve proper alignment, the user looks downwardly at the assembly and lines up the outwardly pointed notches 28 of the lower template with the inwardly pointed notches 36 of the upper template such that a diamond pattern is achieved. Note FIG. 3. The user then is assured of proper alignment of the mask above the nail. After proper placement of the templates, there will be a crescent shaped portion of the user's nail which remains exposed beneath the upper template. This is the potion of the nail that the user wishes to paint.

In a second embodiment, as shown in FIGS. 5 and 6, there is contemplated a filing recess 52 disposed within a curved groove 54 provided in the sloped upper surface 56 of the lower template 58 and extending along the square rearward edge 60 thereof. The filing recess is provided with a coating of gritty material 62 such as emery, sand, or the like, such that the user's fingernails can be shaped therewith.

Figure 7:
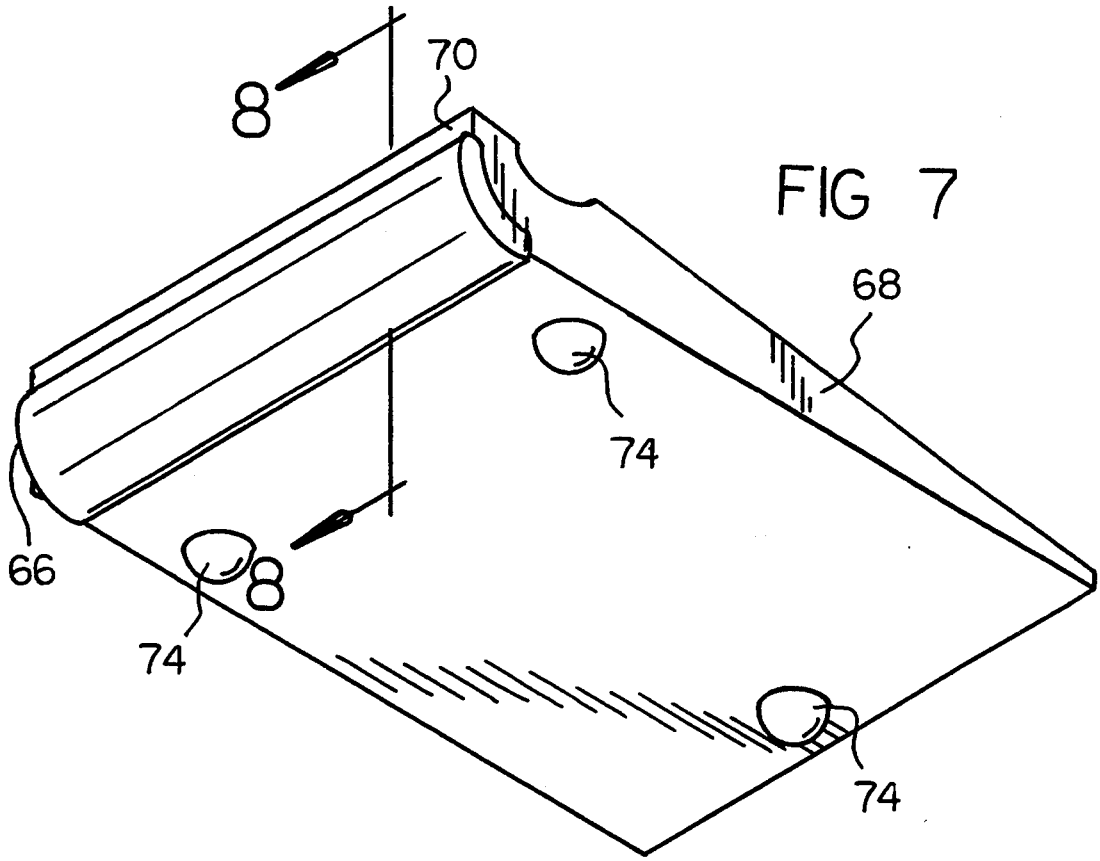
FIG. 7 is bottom perspective view showing an additional alternate embodiment.
Figure 8:
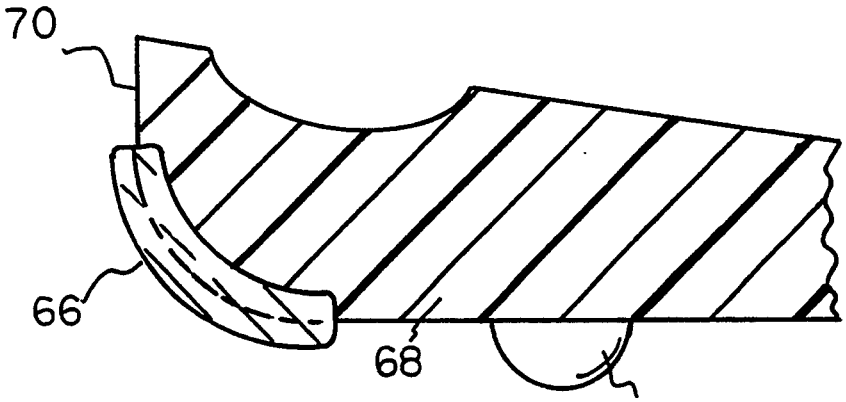
FIG. 8 is a cross-sectional view taken along line 8—8 of FIG. 7.

In another embodiment, that shown in FIGS. 7 and 8, there is provided an elongate and essentially c-shaped resinous buffing pad 66 disposed on the lower template 68 along the bottom of the square rearward edge 70 thereof, extending the entire width of the lower template. The buffing pad 66 is formed of any resinous material including, but not limited to polysilicones, rubbers, polystyrene, or composites thereof. The buffing pad 66 is contemplated in use to assist the user in smoothing the outer surface of the fingernail and extending a more porous surface thereto in preparation for painting or other treatment.

Because the inclusion of the buffing pad 66 interferes with the flat horizontal bottom surface of the lower template, leveling means 74 are provided on the bottom surface of the lower template. The leveling means are semi-spherical and attachedly adhered to the bottom of the template in random fashion to ensure the lower template rests evenly on a horizontal surface when placed thereon.

French manicure templates help the user in performing French manicures quickly and evenly. Salons typically perform this procedure in one of two ways, either freehand or by using a thin piece of tape that outlines the edge of the nail. Unfortunately, both of these methods are time-consuming and difficult to use. The French manicure templates provide a simple technique that virtually anyone can use with a minimum of training.

French manicure templates consist of a hand rest guide and an overlay with different sizes of nails outlined on it. The client's hand rests on the hand rest guide while the procedure is being performed, and then the overlay guide or template is placed over the hand. Both guides have alignment notches. These notches are positioned properly by matching the notches of the upper and lower templates together so they form perfect diamond pattern. This greatly simplifies the process of painting a perfectly curved line of white polish on a client's nails.

The use of the French manicure templates virtually assures the user of consistent quality and customer satisfaction. With its inherent simplicity, it also can be used successfully by individuals who prefer to manicure their fingernails themselves.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A French manicure template comprising, in combination:

a generally parabolic shaped lower template to accept placement of a person's entire hand having a rounded forward edge and a square rearward edge, the lower template being positionable in a horizontal plane, the lower template further being of solid construction and tapering from a larger thickness at the square rearward edge to a smaller thickness at the rounded forward edge, the lower template further containing a sloped upper surface wherein a representation of a human hand including five fingernail defining areas are printed thereon, the upper surface further containing a plurality of outwardly pointed triangular notches printed about the rounded forward edge thereof in fixed spaced relationship such that each fingernail defining area is interposed in linear relationship between two triangular notches;

an upper template, positionable in a horizontal plane and in overlapping relationship with the lower template such that a person's hand may be interposed therebetween, the upper template being wedge shaped and having a curved peripheral edge and a square rearward edge, and being further provided with a plurality of inwardly pointed triangular notches being disposed in fixed spaced-apart relationship about the curved peripheral edge of the upper template, the curved peripheral edge of the template being further provided with a plurality of semi-circular flexible nail masks of varying size, the nail masks containing a rounded edge and a square edge, the square edge being fixedly attached to the template and the rounded edge extending beyond the curved peripheral edge of the template, the nail masks being arranged on the template in order of progressively increasing size and in alternating spaced relationship with the inwardly pointed triangular notches, the upper template further containing on its opposite side, an elliptical grip of spongy fabrication, the grip allowing for ease in handling and placement of the upper template in superimposed relationship with the lower template;

a filing recess disposed within a curved groove provided in the sloped upper surface of the lower template and extending along the square rearward edge thereof, the filing recess further being provided with a coating of gritty material such that fingernails can be shaped therewith;

a resinous buffing pad disposed on the lower template along the bottom of the square rearward edge thereof, the buffing pad being essentially C-shaped and elongate such that the buffing pad extends the entire width of the lower template; and leveling means provided on the bottom of the lower template, the leveling means being semi-spherical and attachedly adhered to the bottom of the template in random fashion to ensure the lower template rests evenly on a horizontal surface when placed thereon.

2. French manicure templates comprising:

a generally parabolic shaped lower template to accept placement of a person's entire hand, having a rounded forward edge and a square rearward edge, the lower template further being positionable in a horizontal plane, and being of solid construction, the lower template further containing an upper surface wherein a representation of a human hand including five fingernail defining areas are printed thereon, the upper surface further containing a plurality of alignment notches printed about the rounded forward edge thereof in fixed spaced relationship such that each fingernail defining area is interposed in linear relationship between two triangular notches; and an upper template, positionable in a horizontal plane and in overlapping relationship with the lower template such that a person's hand may be interposed therebetween, the upper template being wedge-shaped and having a curved peripheral edge and a square rearward edge, and being further provided with a plurality of alignment notches, corresponding with the alignment notches of the lower template and further being disposed in fixed spaced-apart relationship about the curved peripheral edge of the upper template, the curved peripheral edge of the template being further provided with a plurality of semi-circular flexible nail masks of varying size, the nail masks containing a rounded edge and a square edge, the square edge being fixedly attached to the template and the rounded edge extending beyond the curved peripheral edge of the template, the nail masks being arranged on the template in order of progressively increasing size and in alternating spaced relationship with the alignment notches, the upper template further containing on its opposite side, an elliptical grip of spongy fabrication, the grip allowing for ease in handling and placement of the upper template in superimposed relationship with the lower template.

a filing recess disposed within a curved groove provided in the sloped upper surface of the lower template and extending along the square rearward edge thereof, the filing recess further being provided with a coating of gritty material such that fingernails or the like can be shaped therewith;

a resinous buffing pad disposed on the lower template along the bottom of the square rearward edge thereof, the buffing pad being essentially C-shaped and elongate such that the buffing pad extends the entire width of the lower template; and leveling means provided on the bottom of the lower template, the leveling means being semi-spherical and attachedly adhered to the bottom of the template in random fashion to ensure the lower template rests evenly on a horizontal surface when placed thereon.

3. The French manicure templates of claim 2, wherein the lower template tapers from a larger thickness at the square rearward edge to a smaller thickness at the rounded forward edge, such that the upper surface is sloped upwardly, the lower template further containing a filing recess disposed within a curved groove provided in the sloped upper surface of the lower template and extending along the square rearward edge thereof, the filing recess further being provided with a coating of gritty material such that fingernails can be shaped therewith.

4. The French manicure templates of claim 3, and further including a resinous buffing pad disposed on the lower template along the bottom of the square rearward edge thereof, the buffing pad being essentially c-shaped and elongate such that the buffing pad extends the entire with of the lower template; and leveling means provided on the bottom of the lower template, the leveling means being semi-spherical and attachedly adhered to the bottom of the template in random fashion to ensure the lower template rests evenly on a horizontal surface when placed thereon.

* * * * *